United States Patent [19]

Shapiro

[11] 4,023,716

[45] May 17, 1977

[54] MICRO-DISPENSING LIQUID PIPET

[76] Inventor: Justin Joel Shapiro, 1802 Second St., Berkeley, Calif. 94710

[22] Filed: Apr. 20, 1976

[21] Appl. No.: 678,481

[52] U.S. Cl. ..... 222/309; 73/425.4 P

[51] Int. Cl.[2] ..... B01L 3/02

[58] Field of Search ..... 222/309, 42, 49, 50; 128/218 P, 218 PA, 218 R; 73/425.6, 362, 425.4 P

[56] References Cited

UNITED STATES PATENTS

| | | | |
|---|---|---|---|
| 3,766,785 | 10/1973 | Smernoff | 73/425.6 |
| 3,786,683 | 1/1974 | Berman et al. | 73/425.4 P |

*Primary Examiner*—Stanley H. Tollberg
*Attorney, Agent, or Firm*—Herman L. Gordon

[57] ABSTRACT

A liquid microdispenser consisting of a barrel with a snap-on capillary dispensing tube tip at one end containing a dispensing plunger adjustably attached to a tubular operating shaft slidably extending through a flanged bushing threaded into the other end of the barrel. A coiled spring in the barrel bears between an abutment bushing secured in the bottom end of the barrel and an abutment bushing secured on the tubular operating shaft. The plunger is in the form of a rod which is adjustably connected to the operating shaft by a set screw, and the barrel has an aperture providing access to the set screw. The abutment bushing at the bottom end of the barrel is formed at its distal end to accept the snap-on capillary tip for positioning by exerting a force thereon directed along the axis of the barrel. A bushing is secured to the top end of the operating shaft, and a headed cover screw member is threadedly engaged in the last-named bushing. The screw member has a driving stem which can be employed for loosening and tightening the set screw holding the plunger rod in adjusted position. A gauge rod is carried in the tubular operating shaft, the gauge rod being insertable in the bottom of the snap-on dispensing tube tip for setting the rest position of the dispensing plunger for precise volume delivery.

9 Claims, 6 Drawing Figures

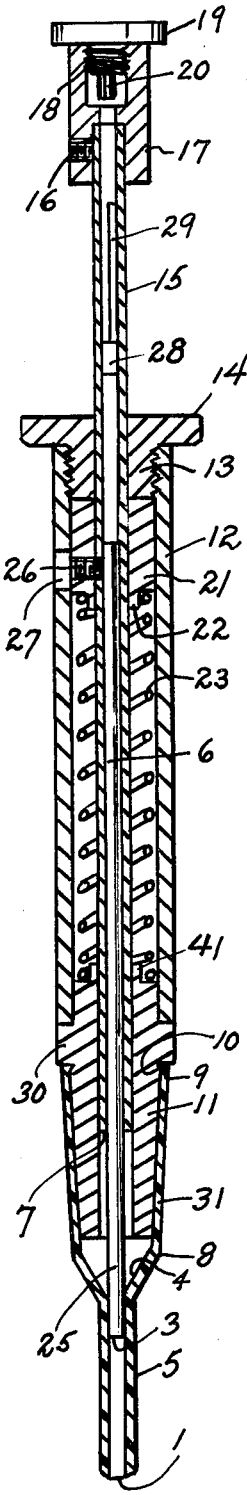
FIG. 1
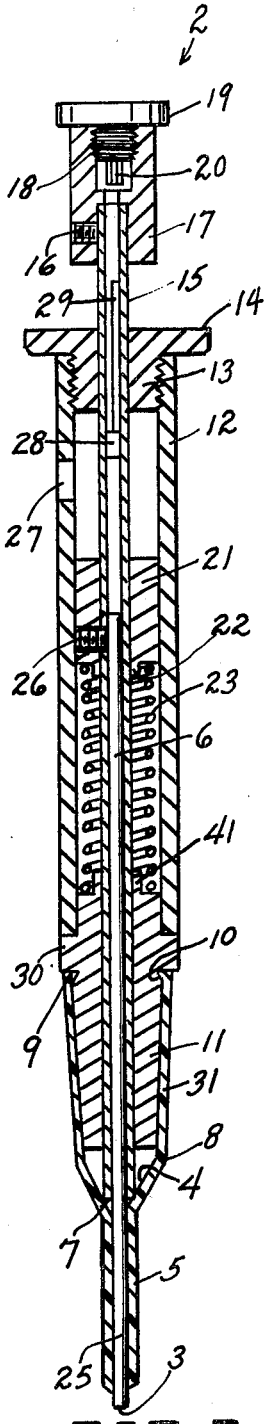
FIG. 2
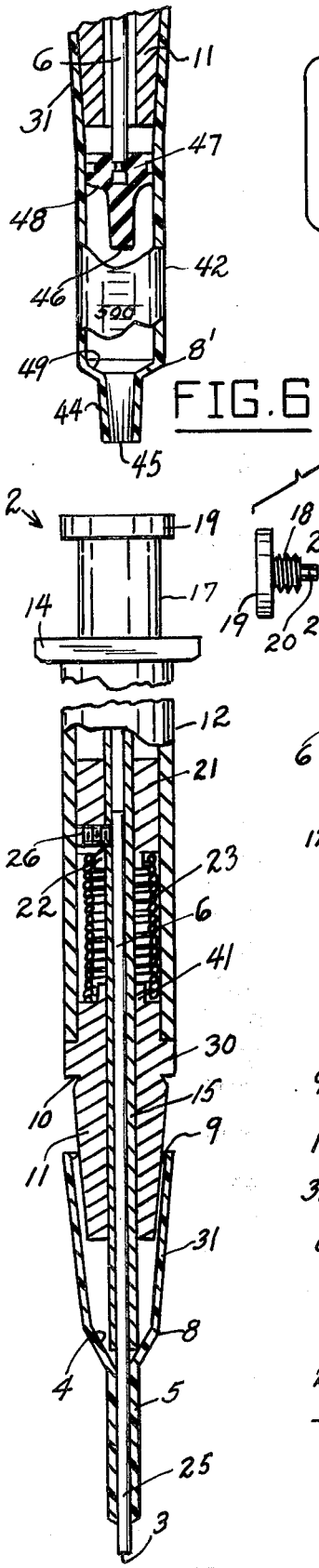
FIG. 6
FIG. 3
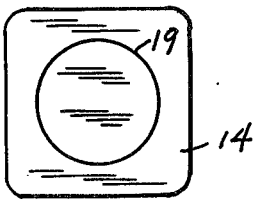
FIG. 5
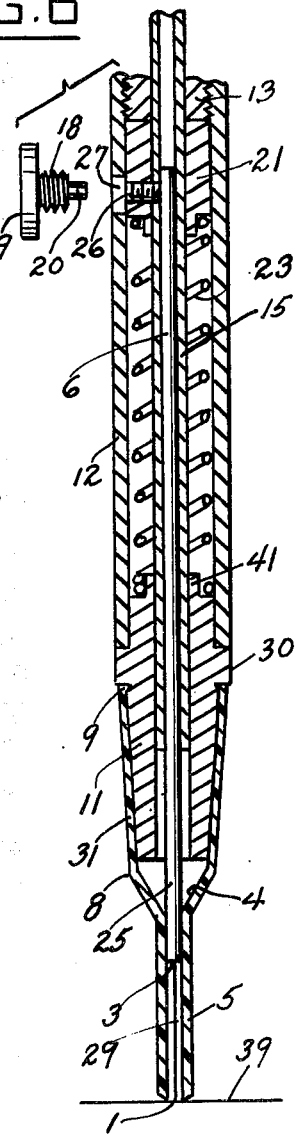
FIG. 4

MICRO-DISPENSING LIQUID PIPET

This invention relates to syringe-type pipets, and more particularly to a microdispensing positive-displacement pipet using a snap-on precision capillary tube as an intake and dispensing conduit, and employing a wiping-contact plunger in the conduit whose travel is limited to deliver an accurately preset volume.

A main object of the invention is to provide a novel and improved microdispensing pipet which is simple in construction, which is easy to operate, which does not use fragile and hazardous glass tips, and which is easily settable to provide a high degree of dispensing accuracy.

A further object of the invention is to provide an improved pipet employing precision disposable tips which are precisely attached and positioned with a straight line motion and which are easily and simply detached, as desired, by the continued forward motion of the plunger after the measured volume has been delivered.

A still further object of the invention is to provide an improved microdispensing liquid pipet which involves relatively few parts, which is inexpensive to manufacture, which is durable in construction, and which is arranged to insure complete delivery of a dispensed sample.

A still further object of the invention is to provide an improved microdispensing liquid pipet which can be easily adjusted for overall dispensing volume, which has an internal adjustable connection for its dispensing plunger rod, which carries its own rod-adjusting tool, which carries its own plunger travel-setting gauge, and which is constructed so that access to its plunger rod-adjustment set screw is provided from the outside of the main barrel of the pipet.

A still further object of the invention is to provide an improved microdispensing liquid pipet which is adapted to accomplish the measured transfer of a liquid sample in a minimum period of time, the pipet having a disposable tip which can be rapidly attached and detached, and can be detached by employing a motion similar to that used to dispense a sample.

A still further object of the invention is to provide an improved microdispensing pipet which includes a calibration rod whose measured length specifies the normal distance of its dispensing plunger from the open end of its dispensing tip, the device having means for storing the rod when not in use and having a removable abutment cap which carries a tool for resetting said normal distance, said cap serving as a cover for the calibration rod storage compartment, which compartment also serves as the operating shaft for the device.

A still further object of the invention is to provide means for the simple change of measured volume of a liquid pipet by altering the travel of its plunger by adjusting its secured length as measured by a gauge rod.

Further objects and advantages of the invention will become apparent from the following description and claims, and from the accompanying drawings, wherein:

FIG. 1 is a vertical cross-sectional view taken through an improved microdispensing pipet according to the present invention, with a dispensing tip in place and with its plunger in released position, corresponding to its position after its has been pressed and released to fill the tip with sample material.

FIG. 2 is a vertical cross-sectional view similar to FIG. 1 with the plunger pressed to discharge position wherein all the sample has been dispensed.

FIG. 3 is an elevational view, partly in vertical cross-section, showing the pipet of FIGS. 1 and 2 with the plunger pressed beyond the point where the sample has been discharged and where the dispensing tip has been forced off the pipet and is ready for easy disposal.

FIG. 4 is a fragmentary vertical cross-sectional view taken through the lower portion of the pipet of FIG. 1 and illustrating the use of the volumetric gauge rod carried by the pipet.

FIG. 5 is a top plan view of the pipet of FIG. 1.

FIG. 6 is a fragmentary vertical cross-sectional view showing the lower portion of a modified form of pipet according to the present invention.

Referring to the drawings, 2 generally designates a typical embodiment of an improved liquid microdispenser according to the present invention. The microdispenser 2 comprises a main barrel 12 in the top end of which is threadedly secured a bushing 13 having a generally square flange 14, which is employed as a lower finger grip.

Designated at 15 is a tubular operating shaft which extends slidably through the central bore of bushing 13. Adjustably secured on the top end of shaft 15, for example, by a set screw 16, is a bushing 17. Threadedly engaged in the bushing 17 is a screw member 18 having the enlarged flange or head 19. Screw member 18 is provided with the depending hexagonal driving stem 20 normally housed in the internally threaded upper bore portion of bushing 17 which receives the screw member.

Rigidly secured on the shaft 15 inside barrel 12 and slidable therein is an abutment collar 21 having a reduced bottom end portion 22 forming a seat for the top end of a biasing coiled spring 23.

A plunger rod 6 is adjustably secured in the lower end of shaft 15 by means of at least one Allen screw 26 threaded through collar 21 and the wall of shaft 15, the Allen screw being accessible from outside of barrel 12 through an aperture 27 provided in the barrel adjacent the rest position of the screw 26. A stop plug 28 is rigidly secured in the bore of shaft 15, defining the uppermost limit of adjustment of rod 6 relative to said shaft. A gauge rod 29 is normally housed in the shaft bore above plug 28.

Rigidly secured in the bottom end of barrel 12 is an abutment bushing 11 which has a reduced portion 41 forming a seat receiving the bottom end of spring 23. The lower end portion of bushing 11 is in the form of a reduced downwardly tapered spout-like member which is annularly grooved at 10 adjacent the unreduced body portion 30 thereof, being formed to fit into the correspondingly-shaped resilient cup-like barrel-coupling portion 31 of a dispensing tip 8. The cup-like portion 31 has at its rim an inwardly projecting integral rib element 9 receivable in said groove or recess 10 with a snap fit. The annular recess has a conical downwardly flaring cross-sectional shape to facilitate disengagement of the tip by the application of downward force thereon. The recess 10 fits the shape of rib element 9 so that the rib element 9 lockingly cooperates with the recess to lock the tip 8 in a fixed position with respect to barrel 12 so as to be held stationary relative to the movable plunger rod 6. Tip 8 has a precision-bore conduit portion 5. The plunger rod 6 extends axially into the precision-bore portion 5 of disposable tip 8, providing a wiping fit for filling and discharging reagent. The distal end 25 of plunger 6 may be coated with a resilient chemically resistant material to provide a more efficient plunger coating. Members 11 and 12 may be fabricated as one piece.

The length of plunger rod 6 is such that when the distal end 7 of tubular shaft 15 reaches the annular shoulder defined by the inner bottom 4 of disposable tip 8, the distal end 3 of plunger 6 emerges from the tip 8 to assure complete discharge of a metered quantity of liquid previously drawn into capillary tube 5 of the tip 8. This metered quantity is equal to the volume in the tube 5 below the plunger tip 3 when it is in the rest position of the plunger as shown in FIG. 1. Since the precision capillary tube 5 has a constant-cross section inside bore, said volume is proportional to the height of the plunger above the bottom end of the tube in the rest position of the plunger.

The tip 8 can be quickly detached for disposal, as desired, by pushing the end 7 of shaft 15 downwardly, by means of push member 19, against the annular shoulder 4 with sufficient force (greater than that required merely for discharge of a sample) to force the retaining flange or rib 9 downwardly out of annular groove 10 and along the downwardly tapering lower end portion of bushing 11, as shown in FIG. 3.

The gauge rod 29 has a length precisely equal to the above-mentioned volume-determining height. Thus, the height can be established by employing the gauge rod 29 to set the plunger rest-position height, thereby calibrating the instrument.

This may be done by unscrewing member 18 from bushing 17 and removing the gauge rod 29. Said gauge rod is then inserted from below into the tube 5 and the tube is held upright on a flat surface 39, as shown in FIG. 4.

The Allen screw 26 is loosened, employing the Allen head wrench element 20 of screw member 18 engaged through aperture 27, and the Allen head wrench is then removed from the aperture 27. If the gauge rod 29 extends below the orifice 1 of tip 8 (plunger rod 6 is too low), the instrument is pressed down until the bottom of rod 29 is at the same level as the tip orifice 1, causing plunger rod 6 to be displaced upwardly the required correction distance relative to tip 8. Screw 26 is then tightened.

If the gauge rod 29 falls within the disposable tip 8 (plunger rod 6 is too high), the head 19 of the plunger is pressed, plug 28 forcing plunger rod 6 downwardly, until the bottom end of the gauge rod 29 is at the same level as orifice 1. Releasing the head 19 will return the hollow shaft 15 to its rest position, the friction of the plunger rod within tube 5 holding the rod in the calibrated position. Screw 26 is then tightened.

The disposable tip 8, shown in FIGS. 1 to 4, is suitable for handling relatively small volumes, for example, of the order of 1 $\mu$l. For larger volumes, such as volumes of the order of 500 $\mu$l, a modified tip structure such as that shown in FIG. 6 may be employed. In this embodiment the disposable dispensing tip is designated generally at 8′, and comprises a main generally cylindrical conduit portion 42 having a relatively constricted axial discharge spout 44 with a bottom orifice 45. The top end of the tip 8′ comprises the upwardly flaring resilient barrel-coupling portion 31 similar to that employed in the first-described embodiment shown in FIGS. 1 to 4, engaged on the depending spout-like member of bushing 11. A resilient deformable plunger 47 is secured to the bottom end of rod 6 and slidably and sealingly engages the inside wall surface of conduit portion 42. The plunger 47 has an integral depending axial stem 46 which is conformably receivable in spout 44, and is of greater length to insure complete discharge.

An annular abutment 48 is defined at the underside of plunger 47 around stem 46, which is cooperable with the annular internal shoulder 49 defined at the bottom end of conduit portion 42 around spout 44 for disengaging the barrel-coupling portion 31 from the depending spout-like member of bushing 11 responsive to a sufficient downward force applied to rod 6 in the same manner as in the previously described form of the invention. Otherwise, abutment element 48 is engageable with the shoulder means 49 to normally limit the discharge movement of plunger 47 in the conduit portion 42.

The larger-volume tip 8′ may be calibrated by the use of a suitable gauge rod, as in the previously described form of the invention, the precision gauging distance being between orifice 45 and the bottom of stem 46.

As an alternative to the use of gauge rods, the tip 8 or 8′ may be made of transparent material; the tube 5 may be marked with fine lines to indicate calibration rest positions of the plunger tip 3 within the tube 5; similarly, in FIG. 6, the conduit portion 42 may be marked with desired volume-setting calibration lines.

While certain specific embodiments of an improved microdispenser have been disclosed in the foregoing description, it will be understood that various modifications within the spirit of the invention may occur to those skilled in the art. Therefore it is intended that no limitations be placed on the invention except as defined by the scope of the appended claims.

What is claimed is:

1. A pipet comprising a main barrel provided with an axial operating shaft slidably engaged in the barrel, a dispensing tip yieldably connected to said main barrel, said dispensing tip comprising a yieldable barrel-coupling portion and a conduit portion, a plunger operatively engaged in said conduit portion, means coaxially connecting said plunger to said shaft, whereby the plunger can be reciprocated by reciprocating said shaft, and means to disengage said barrel-coupling portion from the barrel at times responsive to axial force exerted on said shaft, wherein said tip includes annular internal shoulder means, wherein said disengaging means comprises abutment means moving with said shaft and being engageable with said shoulder means to transmit said axial force, and wherein said abutment means is engageable with said shoulder means to normally limit the discharge movement of said plunger in said conduit portion.

2. The pipet of claim 1, and cooperating stop means on the barrel and the shaft to limit intake movement of said plunger in said conduit portion.

3. The pipet of claim 2, and spring means in the barrel biasing said shaft towards its intake limiting position relative to the barrel.

4. The pipet of claim 1, and wherein said barrel-coupling portion comprises a resilient cup-like member clampingly receiving said barrel.

5. The pipet of claim 4, and wherein said barrel has an annularly recessed reduced spout portion received in said cup-like member.

6. The pipet of claim 5, and wherein said spout portion has an annular recess adjacent the unreduced body portion of the barrel and said cup-like member has an inwardly projecting rib element receivable in said annular recess.

7. The pipet of claim 1, and wherein said barrel-coupling portion comprises a resilient cup-like member, and wherein said barrel has an annularly recessed tapered reduced spout portion received in said cup-like member, said cup-like member having an inturned peripheral rib engaged in the annular recess of said spout portion.

8. The pipet of claim 7, and wherein said cup-like member is formed to define an annular shoulder engageable by the end of the shaft in the discharge limiting position of the plunger and defining an abutment for transmitting disengagement force from the shaft to the dispensing tip.

9. A pipet comprising a main barrel provided with an axial operating shaft slidably engaged in the barrel, a dispensing tip yieldably connected to said main barrel, said dispensing tip comprising a yieldable barrel-coupling portion and a conduit portion, a plunger operatively engaged in said conduit portion, means coaxially connecting said plunger to said shaft, whereby the plunger can be reciprocated by reciprocating said shaft, and means to disengage said barrel-coupling portion from the barrel at times responsive to axial force exerted on said shaft, and wherein said shaft is tubular and said plunger has a supporting portion telescopically engaged in said tubular shaft, and wherein the means connecting said plunger to said shaft comprises an abutment collar surrounding said shaft and slidable in said main barrel, and a clamping screw threadedly engaged in said collar and extending through the wall of the shaft in clamping engagement with said plunger, said barrel being provided with an aperture located to afford access to said clamping screw.

* * * * *